US007685729B2

(12) United States Patent
Mershon

(10) Patent No.: US 7,685,729 B2
(45) Date of Patent: Mar. 30, 2010

(54) REMOVABLE GRADE PIN SYSTEM

(76) Inventor: Michael S. Mershon, 725 W. County Rd. 1300 N., Brazil, IN (US) 47834

( * ) Notice: Subject to any disclaimer, the term of this patent is extended or adjusted under 35 U.S.C. 154(b) by 94 days.

(21) Appl. No.: 11/987,799

(22) Filed: Dec. 4, 2007

(65) Prior Publication Data

US 2008/0236059 A1 Oct. 2, 2008

Related U.S. Application Data

(60) Provisional application No. 60/907,374, filed on Mar. 29, 2007.

(51) Int. Cl.
*E01C 23/01* (2006.01)

(52) U.S. Cl. ..... 33/521; 33/526; 249/207; 52/742.14

(58) Field of Classification Search ..... 33/518, 33/521, 526, 527, 227, 228, 293, 296; 116/200, 116/209; 249/2–7, 34, 207, 53 R, 83, 96, 249/210; 264/31; 52/127.3, 364, 370, 742.14, 52/105, 126.1, 126.5, 741.15, 745.12
See application file for complete search history.

(56) References Cited

U.S. PATENT DOCUMENTS

| | | | | | |
|---|---|---|---|---|---|
| 2,224,273 | A | * | 12/1940 | Neptune | 52/679 |
| 2,523,255 | A | * | 9/1950 | Coleman | 33/413 |
| 2,586,074 | A | | 2/1952 | Memluck | |
| 2,867,041 | A | | 1/1959 | McMillan | |
| 2,873,529 | A | | 2/1959 | Hogan et al. | |
| 3,230,626 | A | | 1/1966 | Berrien | |
| 3,321,834 | A | * | 5/1967 | Burns | 33/293 |
| 3,367,031 | A | * | 2/1968 | Ward | 33/296 |
| 3,552,734 | A | * | 1/1971 | Severino et al. | 269/287 |
| 4,141,310 | A | | 2/1979 | Rich, Jr. | |
| 4,649,678 | A | | 3/1987 | Lamson | |
| 4,932,818 | A | * | 6/1990 | Garwood | 411/107 |
| 4,970,795 | A | | 11/1990 | Woodward et al. | |
| 5,173,004 | A | | 12/1992 | Fahrenkrog | |
| 5,621,976 | A | | 4/1997 | Ochsenbine | |
| 5,943,784 | A | | 8/1999 | Hiramine | |
| 6,421,926 | B1 | | 7/2002 | Cappuccio | |
| 6,760,974 | B1 | * | 7/2004 | Jorgenson | 33/296 |
| 6,964,115 | B2 | | 11/2005 | Kim | |
| 7,174,689 | B2 | * | 2/2007 | Alyea et al. | 52/700 |
| 7,225,589 | B1 | * | 6/2007 | Smith | 52/292 |
| 7,257,903 | B2 | * | 8/2007 | Lee | 33/293 |

* cited by examiner

*Primary Examiner*—Amy Cohen Johnson
(74) *Attorney, Agent, or Firm*—Richard C. Litman

(57) ABSTRACT

The removable grade pin system includes a base pin and a removable upper pin. The base pin is a rod that is driven into the ground within the concrete form, typically such that the head of the base pin is approximately two inches below the desired level of concrete. The upper pin is a rod with a hollow bore formed in its lower end having a diameter slightly larger than the head of the base pin so that the upper pin telescopes over the base pin. The upper pin has an annular plate or disc extending about its center or medial section to mark the desired level of the concrete. The upper end of the upper pin provides a handle to remove the upper pin when the desired level of concrete has been poured into the form. The position of the circular plate on the upper pin may be adjustable.

6 Claims, 7 Drawing Sheets

REMOVABLE GRADE PIN SYSTEM

CROSS-REFERENCE TO RELATED APPLICATION

This application claims the benefit of U.S. Provisional Patent Application Ser. No. 60/907,374, filed Mar. 29, 2007.

BACKGROUND OF THE INVENTION

1. Field of the Invention

The present invention relates to a masonry tools, and particularly to a removable grade pin system for providing an even grade when pouring concrete into a form.

2. Description of the Related Art

When pouring concrete, a form is typically constructed about the region where the concrete is to be poured. The form is typically a rectangular boundary, formed of plywood or the like, which forms a boundary of the area to receive the concrete. Once the liquid concrete has hardened, the form is then removed. When forming a floor surface, for example, the form typically has a height matching the desired floor surface level.

Due to the semi-solid, viscous nature of concrete, it is very difficult to visually determine the proper thickness of the poured concrete, particularly in the center of the form, away from the edges. Contractors typically utilize "grade pins" or "grade stakes", which are stakes positioned within the center of the form, with a height matching the desired thickness of the concrete layer.

Once the concrete has been poured, a screed is used flatten and smooth the upper surface level. However, the grade stakes must be removed prior to the screeding process. The grade stakes are commonly either driven into the ground through the liquid concrete (which causes the liquid concrete to splash and also cover the hammer or other driving tool), or are removed with pliers or the like, which also may cause splashing and covering of the tool or the user's hands with the liquid concrete.

Further, grade pins or grade stakes are often difficult to see when the concrete is poured, particularly because the concrete is typically poured slightly over the upper end of the grade stake. Thus, a removable grade pin system solving the aforementioned problems is desired.

SUMMARY OF THE INVENTION

The removable grade pin system includes a base pin and a removable upper pin. The base pin is a rod that is driven into the ground inside the area of the concrete form, typically so that the head of the base pin is about two inches below the desired level of concrete. The upper pin is a rod with a hollow bore in its lower end having a diameter slightly larger than the head of the base pin so that the upper pin telescopes over the base pin. The upper pin has a circular annular plate or disc extending about its center or medial section to mark the desired level of the concrete. The upper end of the upper pin provides a handle to remove the upper pin when the desired level of concrete has been poured into the form. The position of the circular plate on the upper pin may be adjustable.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 2A:
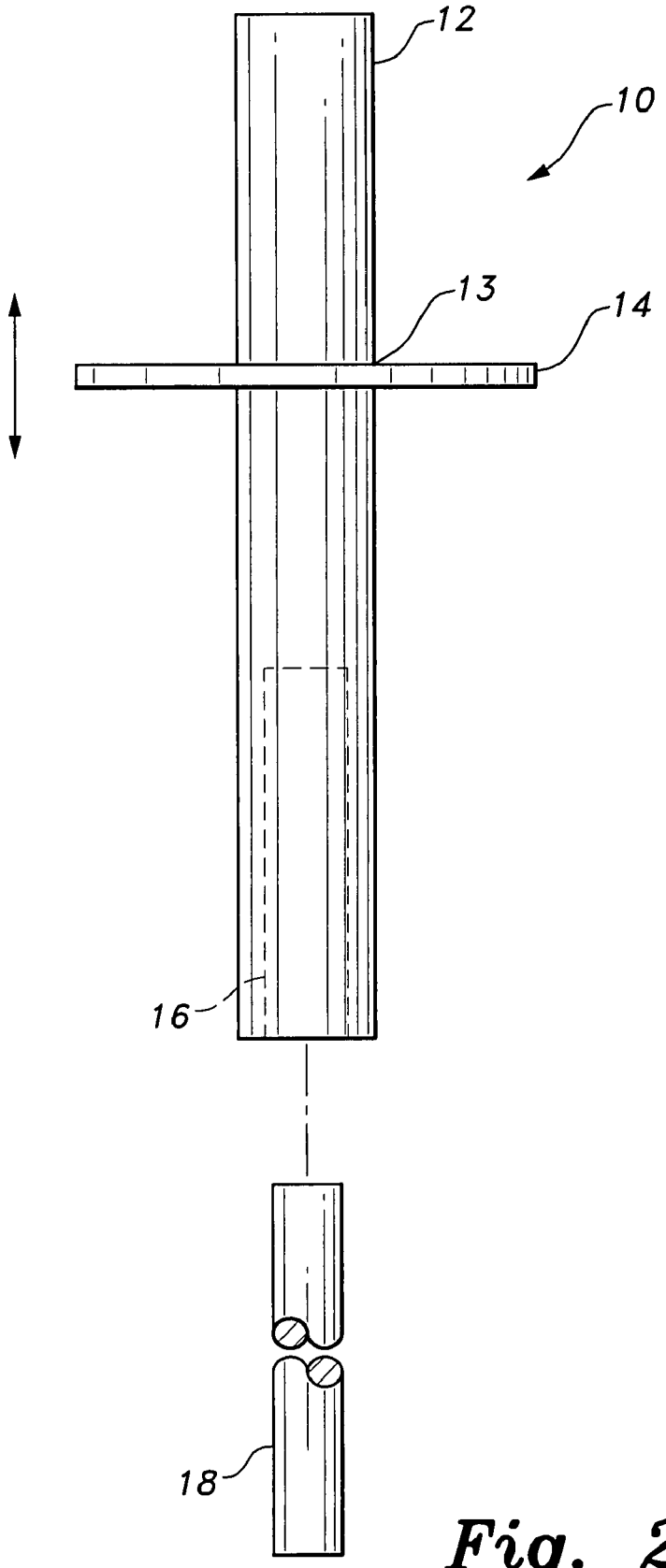
FIG. 2A is a partially exploded front view of the removable grade pin system according to the present invention.
Figure 2B:
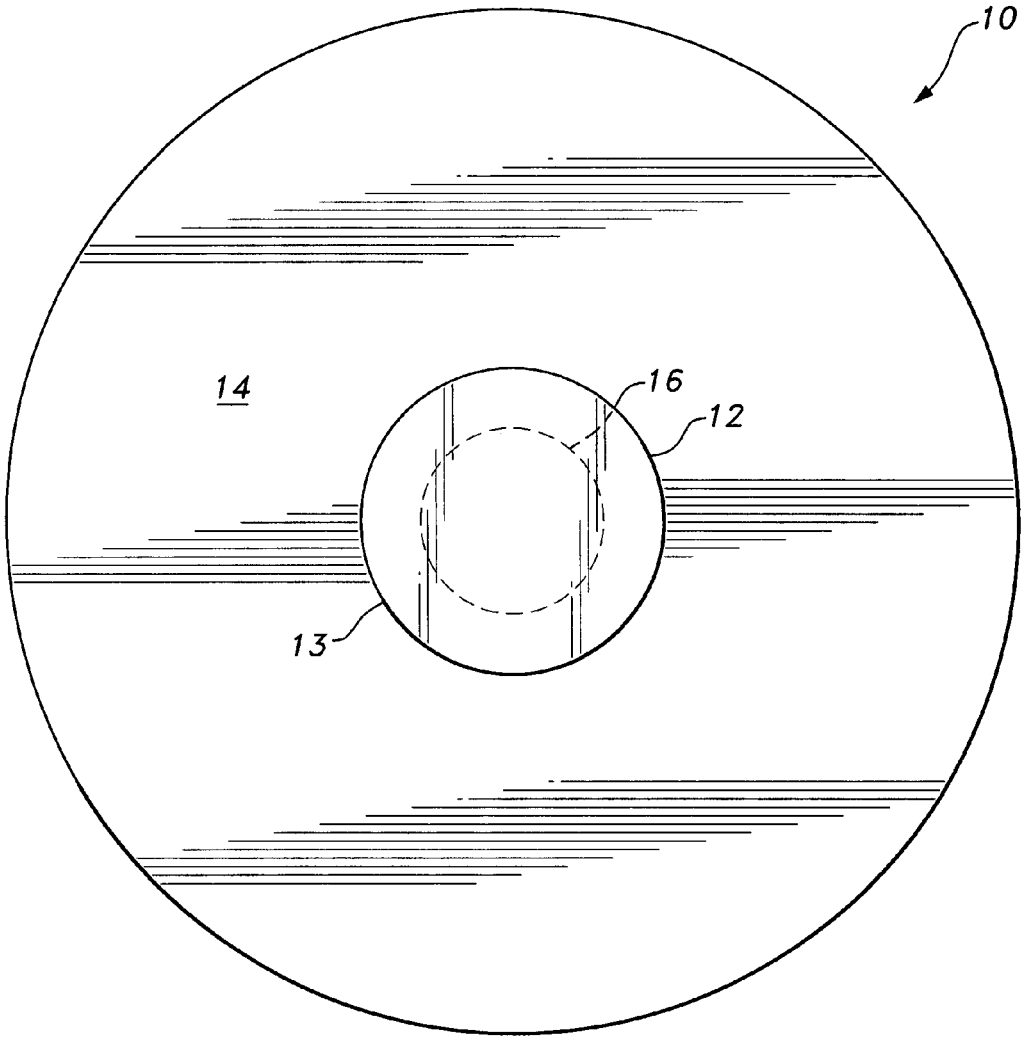
FIG. 2B is a top plan view of the removable grade pin system according to the present invention.

The present invention is directed towards a removable grade pin system. As shown in FIG. 2A, the removable grade pin system 10 includes an upper pin 12 and a base pin 18. The lower end of the upper pin 12 has a blind bore 16 axially formed therein having a diameter slightly larger than the head of the base pin 18 so that the upper pin telescopes over the base pin.

The upper pin has an annular circular plate 14 or disc disposed about its center or medial portion. The position of the plate 14 on the upper pin 12 may be adjustable. For example, the plate 14 may have a hole 13 formed in its center that frictionally engages the shaft of the upper pin 12. Alternatively, the plate 12 may have an active mechanism for positively engaging the shaft of upper pin 12, e.g., a detent mechanism.

Representative dimensions of the system 10 may include: a plate 14 diameter of approximately 2½ inches; an upper pin 12 diameter of approximately ¾ of an inch; an upper pin 12 length of approximately 5½ inches; a bore 16 length of approximately 2 inches; and a plate 14 position of approximately two inches from the top of upper pin 12. Upper pin 12 and plate 14 may be formed from any suitable non-corrosive materials, such as plastic or stainless steel. Base pin 18 may have a diameter of ⅜ of an inch. Base pin 18 may be formed from any suitable, structurally stable material, such as iron, plastic or steel The above dimensions may be useful when the user desires a floor having a thickness of 3½ inches, with plate 14 being permanently fixed 3½ inches above the lower end of upper pin 12, and two inches below the upper end of upper pin 12. Base pin 18 is driven into the ground 20 below the upper surface of form 22 (which has a height of 3½ inches), and the concrete is poured, leaving the user with a 2-inch upper portion of upper pin 12 forming a handle to grasp for removal thereof. It will be understood, however, that the above dimensions are representative, and the system 10 may be provided in various sizes to adapt to various situations.

Figure 1:
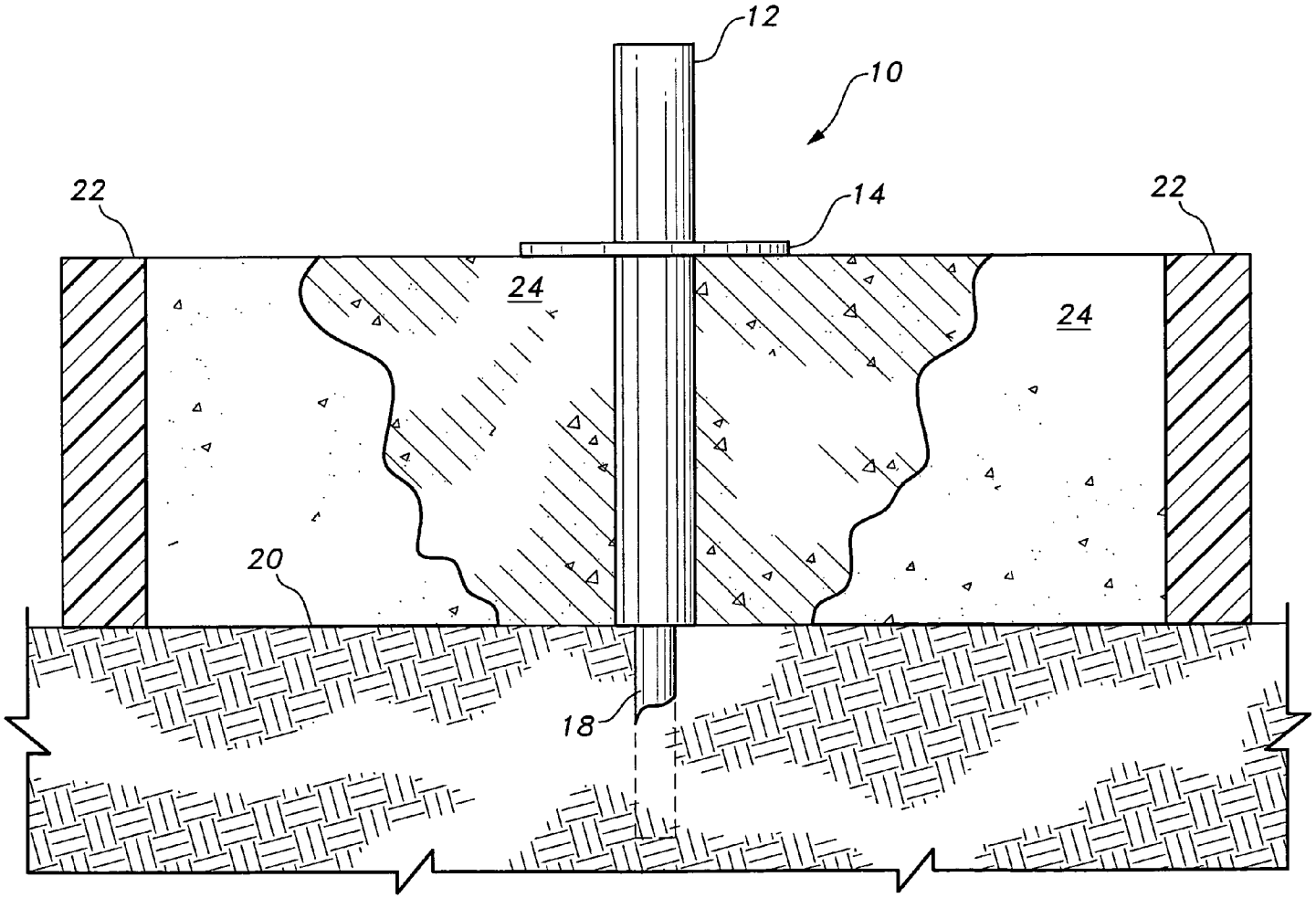
FIG. 1 is an environmental side view of a removable grade pin system according to the present invention positioned in a concrete form, the form being in section and the concrete being broken away.
Figure 3:
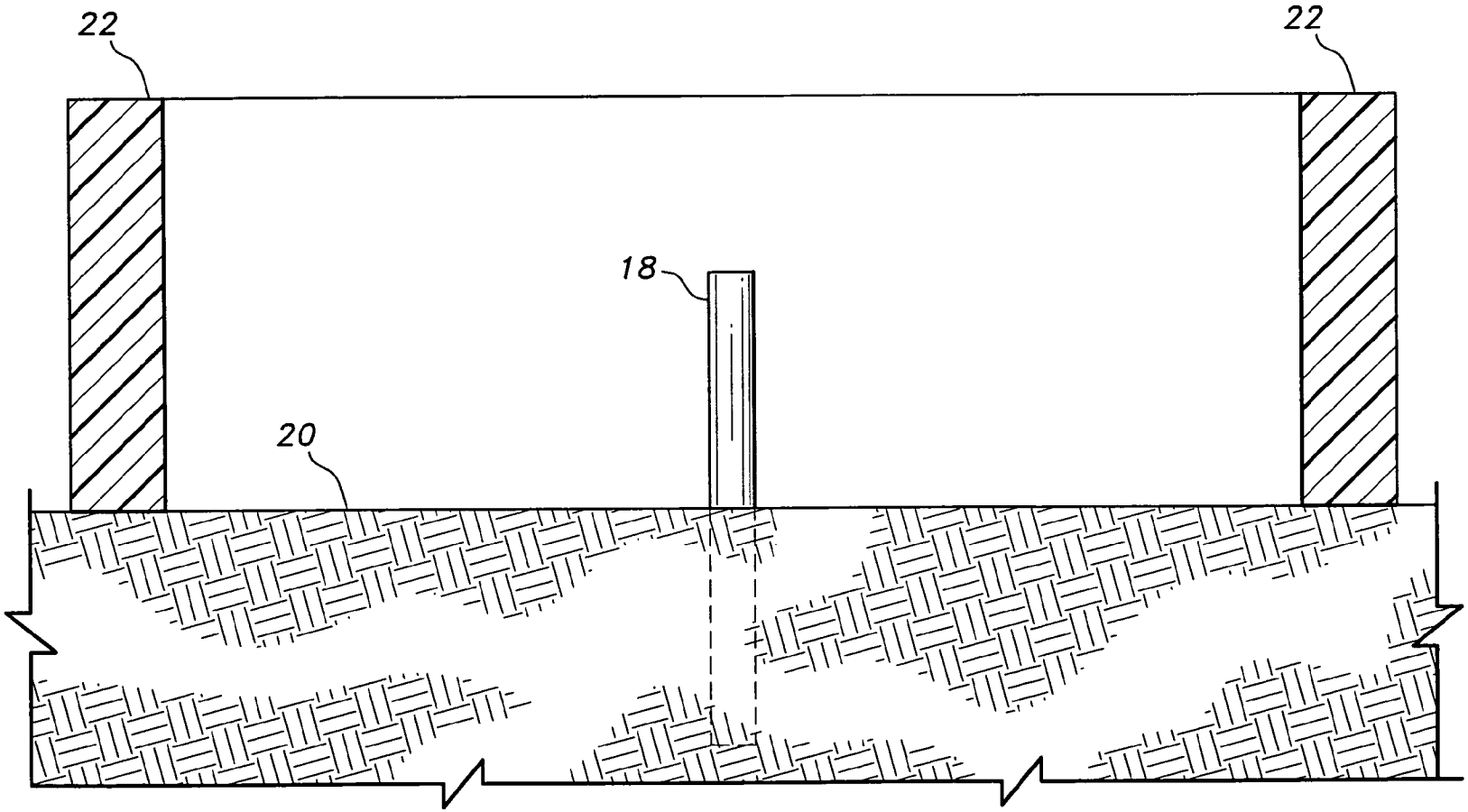
FIG. 3 is an environmental side view showing a first step of using the removable grade pin system according to the present invention.
Figure 4:
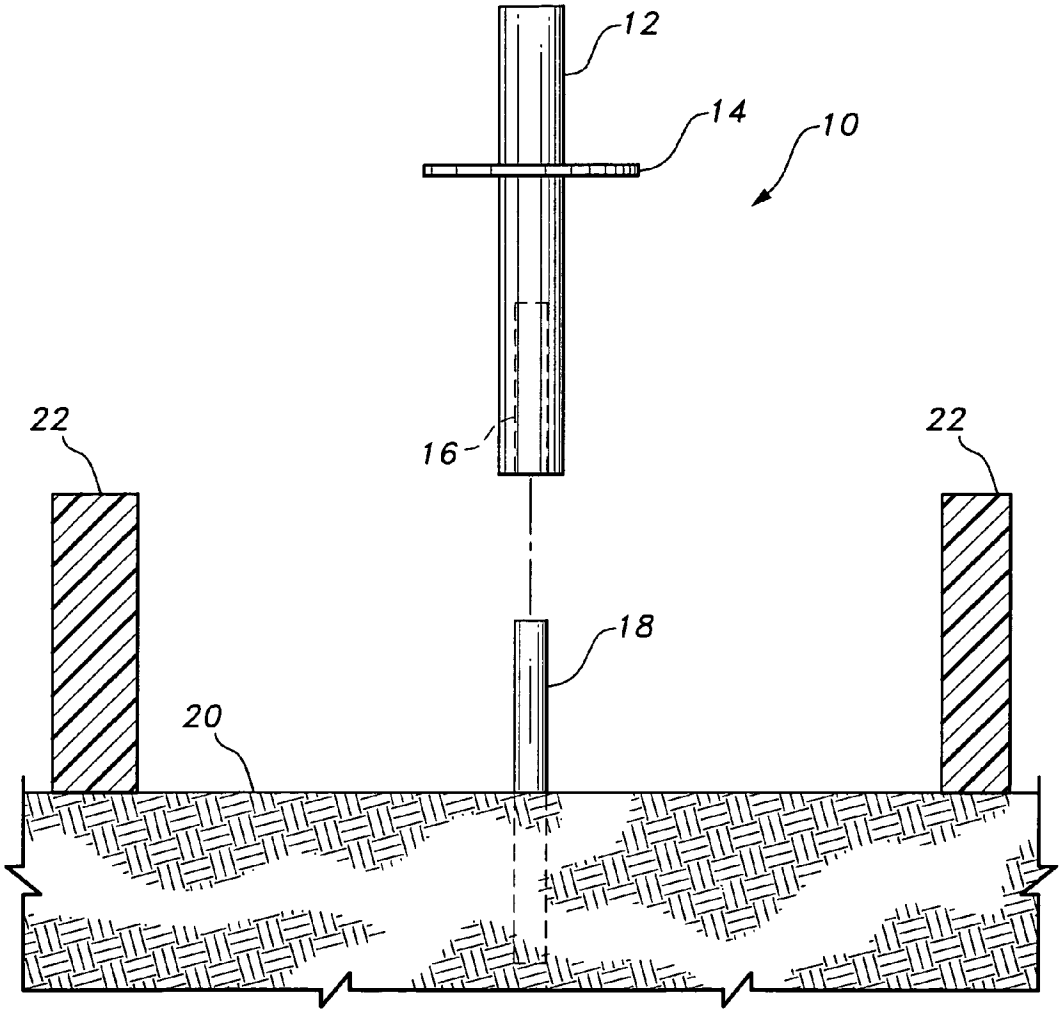
FIG. 4 is an environmental side view showing a second step of using the removable grade pin system according to the present invention.
Figure 5:
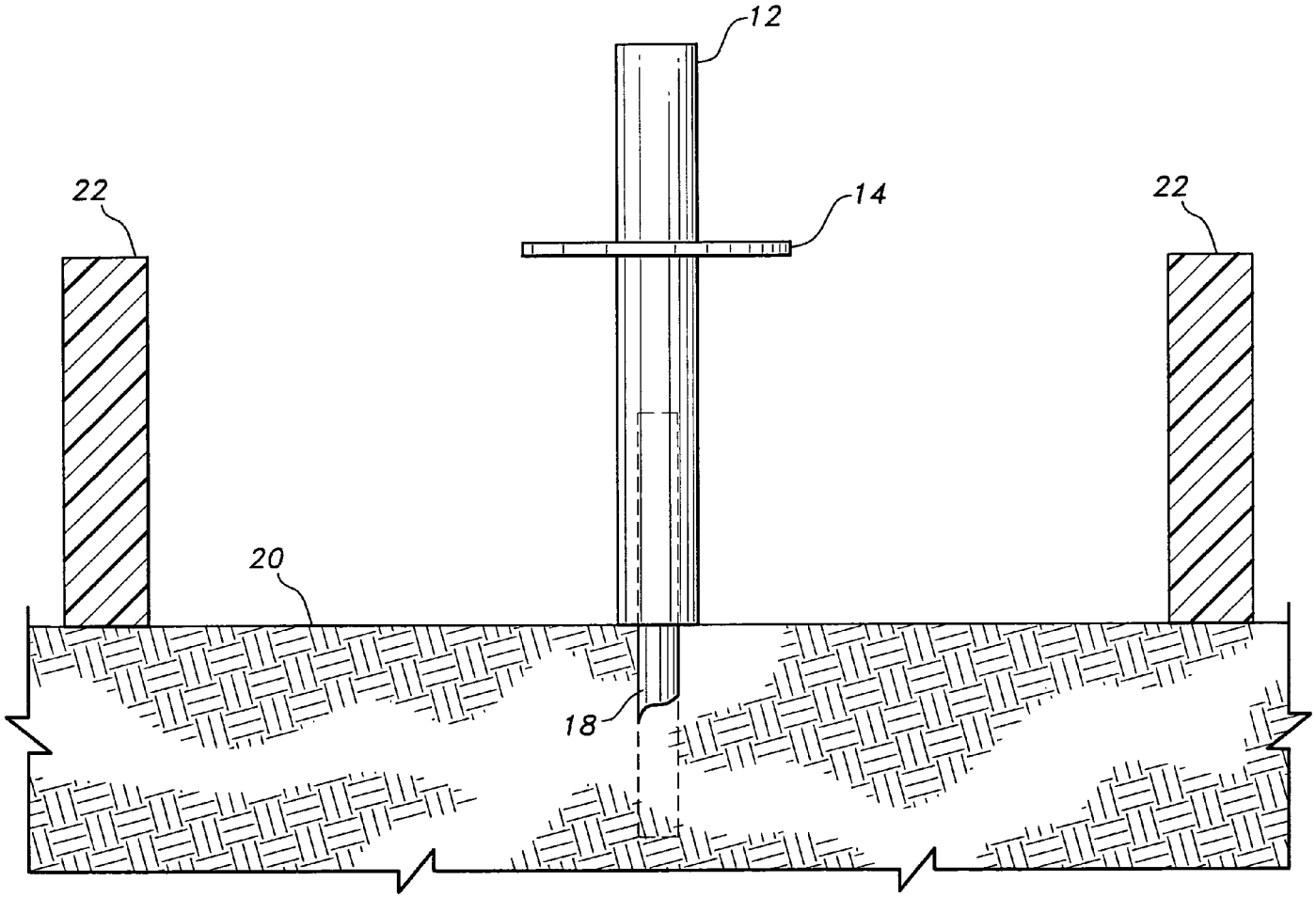
FIG. 5 is a side view showing a third step of using the removable grade pin system according to the present invention.
Figure 6:
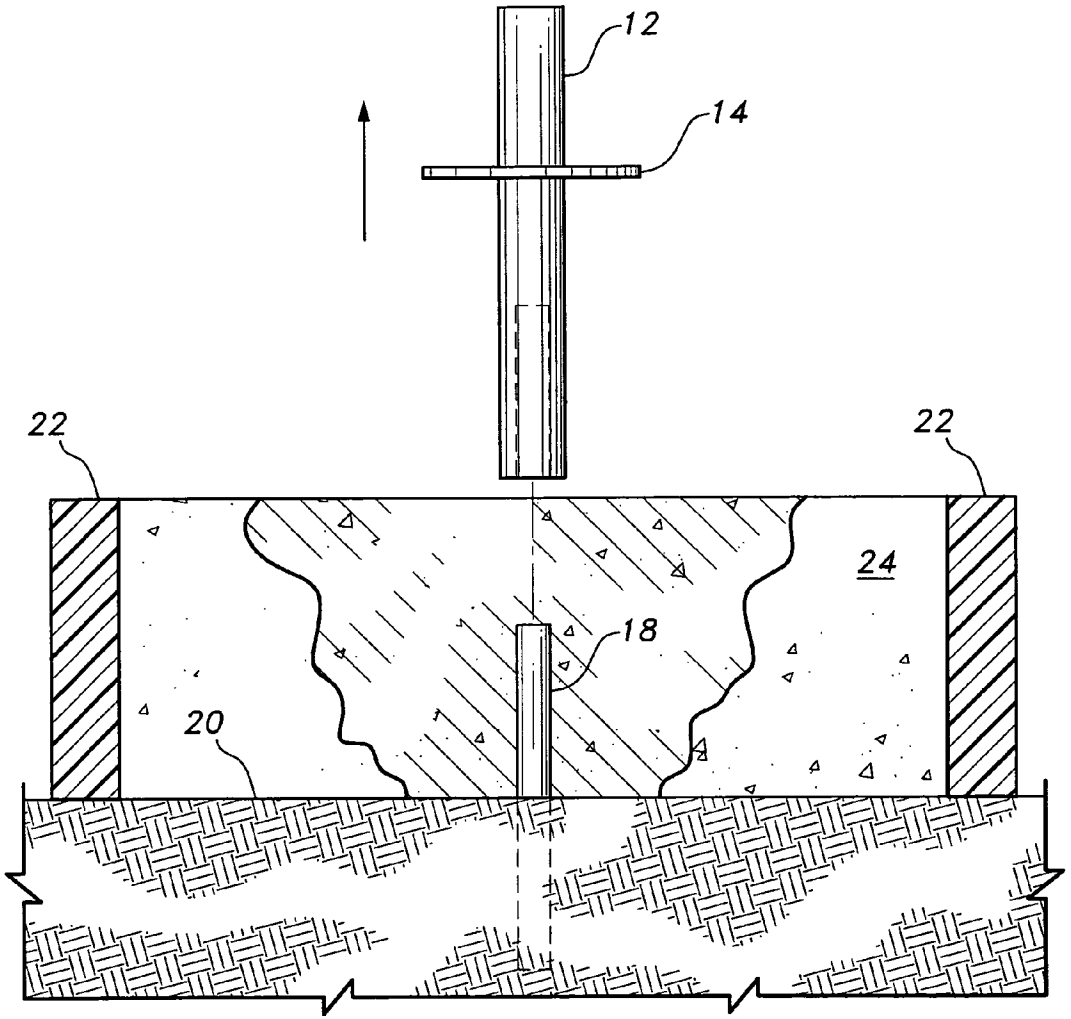
FIG. 6 is a side view showing a final step of using the removable grade pin system according to the present invention.

In use, base 18 is inserted partially into the ground 20 within the boundaries of concrete form 22, as shown in FIG. 3. The lower end of the base pin 18 is driven into the ground stably so that the upper end of base pin 18 projects upwardly from the ground in a substantially vertical orientation. Base pin 18 is positioned so that its head is below the top edge of form 22, as shown. The upper end of base pin 18 is then removably received within bore 16 formed in the lower end of the upper pin 12 prior to the pouring of liquid concrete 24 into the concrete form 22, as shown in FIG. 4. The upper pin 12 is telescopingly mounted on the base pin 18, and plate 14 is vertically adjusted to the desired upper surface level of the layer of concrete 24; i.e., to match the height of the concrete form 22, as shown in FIG. 5. The user then pours the concrete 24 until the upper surface of the liquid concrete 24 is adjacent and contiguous with the plate 14, as shown in FIG. 1, and then the user removes the upper pin 12 with the attached plate 14 from the concrete 24, as shown in FIG. 6. The base pin 18 is left in the ground 20 and within the concrete layer 24.

Although only a single system 10 is shown in the drawings, it should be understood that multiple systems 10 may be used when pouring a single concrete form, preferably with each being positioned approximately eight feet apart within form 22. The projecting upper end or handle of upper in 12 allows for the easy removal thereof once the concrete has been poured.

It is to be understood that the present invention is not limited to the embodiment described above, but encompasses any and all embodiments within the scope of the following claims.

I claim:

1. A removable grade pin system, comprising:

a base pin adapted for insertion into the ground within a concrete form, the base pin having a head defining a base pin diameter;

an upper pin having an upper end and a lower end, said upper pin having an axial blind bore formed in the lower end, the bore having a diameter slightly larger than the base pin diameter, the upper pin telescoping over the head of the base pin; and an annular plate medially disposed on the upper pin, wherein said plate is adjustably positioned along the length of said upper pin in order to set a depth of concrete to be poured within the form.

2. The removable grade pin system as recited in claim 1, wherein said upper pin is substantially cylindrical.

3. The removable grade pin system as recited in claim 2, wherein said base pin is substantially cylindrical.

4. The removable grade pin system as recited in claim 3, wherein the axial blind bore in said upper pin is substantially cylindrical.

5. The removable grade pin system as recited in claim 1, wherein said plate frictionally engages said upper pin.

6. A method for pouring concrete at a predetermined height, comprising the steps of:

positioning a concrete form on the ground;

partially inserting a base pin into the ground within the concrete form so that an upper portion of the base pin is positioned aboveground;

telescoping an upper pin having an axial blind bore defined therein onto the base pin, the upper pin having an annular plate disposed thereon;

adjusting the height of the annular plate on said upper pin to a desired height of concrete to be poured;

pouring the concrete within the form so that the height of the concrete matches the height of the plate; and removing the upper pin and plate.

* * * * *